US012285655B2

(12) United States Patent
Xie

(10) Patent No.: US 12,285,655 B2
(45) Date of Patent: Apr. 29, 2025

(54) LUMINOUS BALL

(71) Applicant: Penghui Xie, Shenzhen (CN)

(72) Inventor: Penghui Xie, Shenzhen (CN)

(73) Assignee: Shenzhen Jiaxin Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/914,306

(22) Filed: Oct. 14, 2024

(65) Prior Publication Data

US 2025/0032861 A1 Jan. 30, 2025

(51) Int. Cl.

*A63B 43/06* (2006.01)
*A63B 41/04* (2006.01)
*A63B 41/08* (2006.01)

(52) U.S. Cl.

CPC ..... *A63B 43/06* (2013.01); *A63B 41/04* (2013.01); *A63B 41/085* (2013.01)

(58) Field of Classification Search

CPC ..... A63B 43/06; A63B 41/04; A63B 41/085
See application file for complete search history.

(56) References Cited

U.S. PATENT DOCUMENTS 1,641,382 A * 9/1927 Goldsmith ..... F16K 15/202 473/611
2,387,455 A * 10/1945 McDermott ..... F16K 15/202 473/611
3,905,387 A * 9/1975 Grant ..... F16K 15/202 137/223
4,320,776 A * 3/1982 Yang ..... A63B 41/04 473/610
4,577,865 A * 3/1986 Shishido ..... A63B 43/00 473/570
4,595,200 A * 6/1986 Shishido ..... A63B 43/00 473/570
5,236,383 A * 8/1993 Connelly ..... A63B 43/06 473/576
5,775,800 A * 7/1998 Hsieh ..... F21V 33/008 362/800
5,915,407 A * 6/1999 West ..... F16K 15/202 446/224
8,292,764 B2 * 10/2012 Steidle ..... B29C 45/1676 473/610

(Continued)

*Primary Examiner* — Steven B Wong

(57) ABSTRACT

A luminous ball includes a light-transmittance inner airbag, a light-transmittance outer surface layer, a light-emitting assembly and a cover body. The light-transmittance inner airbag defines an inflation space. An accommodating slot is provided in the light-transmittance inner airbag. The outer wall of the accommodating slot extending into the inflatable space from the outside. The light-transmittance outer surface layer is wrapped around an outer surface of the light-transmittance inner airbag. The light-transmittance outer surface layer is provided with a first opening. The light-emitting assembly is detachably inserted into the accommodating slot. The cover body is in detachable threaded connection to an inner wall of the accommodating slot and covers the accommodating slot to limit the light-emitting assembly in the accommodating slot. The cover body is in detachable to the accommodating slot and covers the accommodating slot to limit the light-emitting assembly in the accommodating slot.

20 Claims, 10 Drawing Sheets

(56) References Cited

U.S. PATENT DOCUMENTS

| | | | | |
|---|---|---|---|---|
| 8,540,595 | B1 * | 9/2013 | Lin | F16K 15/202 473/610 |
| 8,579,744 | B2 * | 11/2013 | Chou | F16K 15/202 473/610 |
| 8,771,115 | B2 * | 7/2014 | Berggren | A63B 45/00 473/610 |
| 9,384,676 | B2 * | 7/2016 | Costain | A63B 41/00 |
| 10,076,685 | B2 * | 9/2018 | King | H02J 50/90 |
| 11,266,883 | B2 * | 3/2022 | Ianni | A63B 43/004 |
| 12,145,028 | B2 * | 11/2024 | Liang | H02J 7/0042 |
| 2003/0144096 | A1 * | 7/2003 | Lee | A63B 41/04 473/611 |
| 2007/0021244 | A1 * | 1/2007 | Ko | A63B 41/00 473/570 |
| 2011/0136604 | A1 * | 6/2011 | Hsu | A63B 41/00 473/609 |
| 2012/0058845 | A1 * | 3/2012 | Crowley | A63B 41/00 206/522 |
| 2015/0157900 | A1 * | 6/2015 | Holthouse | A63B 41/04 473/570 |
| 2015/0196811 | A1 * | 7/2015 | Laurienzo | A63B 43/00 473/570 |
| 2016/0243410 | A1 * | 8/2016 | Larson | A63B 41/085 |
| 2016/0354646 | A1 * | 12/2016 | Wang | A63B 43/06 |
| 2018/0043218 | A1 * | 2/2018 | Hu | A63B 41/00 |
| 2019/0309864 | A1 * | 10/2019 | Bouteiller | F16K 15/147 |

* cited by examiner

LUMINOUS BALL

TECHNICAL FIELD

The present disclosure relates to the technical field of ball equipment, and in particular, to a luminous ball.

BACKGROUND OF THE INVENTION

As a widely popular and interesting sport, ball sports have been favored since they emerged. People often engage in ball sports such as basketball, football, and rugby in their spare time. Even in a low light environment such as at night, there are still many ball sports enthusiasts engaging in ball sports.

However, most existing balls on the market are not luminous, so that ball sports enthusiasts have to engage in ball sports in an environment with sufficient lighting, which limits usage scenarios and brings inconvenience to use by people. Some balls will be provided with lamps. Shells of some of these products cannot transmit light, and shells of some other products have poor light transmittance. If weak light is emitted, the products cannot be easily observed in a dark environment. Some lamps emit strong light which may easily directly hit the eyes of the ball sports enthusiasts. This affects the user experience. Moreover, batteries and lamps on some balls cannot be replaced, or it is troublesome to replace the batteries and lamps, and special tools need to be used. Once the batteries are depleted or the lamps are damaged, the entire products cannot be luminous and cannot continue to be used in the low light environment. There are still some products having smooth outer surfaces and low friction force. This product easily falls off from the hands of a user when the user holds the product. In addition, their shells are too hard, so that the hand feel is poor.

Therefore, the present disclosure provides a luminous ball that can effectively solve the above problems. The luminous ball has a simple structure, and it is convenient to replace the battery and the lamp. Furthermore, the product emits softer light.

SUMMARY OF THE INVENTION

In order to overcome the shortcomings of the prior art, the present disclosure provides a luminous ball. The luminous ball has a simple structure, and it is convenient to replace the battery and the lamp. Furthermore, the product emits softer light.

The technical solution adopted by the present disclosure to solve the technical problem is as follows.

A luminous ball, includes:

a light-transmittance inner airbag, wherein the light-transmittance inner airbag defines an inflation space and a second opening communicated to the inflation space, and the light-transmittance inner airbag is made of polyvinyl chloride (PVC) or rubber;

an accommodating shell, wherein an accommodating slot is provided in the accommodating shell; the accommodating shell is connected to a position, close to an edge of the second opening, of the light-transmittance inner airbag; the accommodating shell is at least partially placed into the inflation space;

a light-transmittance outer surface layer, wherein the light-transmittance outer surface layer is wrapped around an outer surface of the light-transmittance inner airbag; the light-transmittance outer surface layer is provided with a first opening; the first opening corresponds to the second opening; and the light-transmittance outer surface layer is made of PVC or fabric;

a light-emitting assembly, wherein the light-emitting assembly is detachably inserted into the accommodating slot; and a cover body, wherein the cover body is in detachable threaded connection to an inner wall of the accommodating slot and covers the accommodating slot to limit the light-emitting assembly in the accommodating slot.

As an improvement of the present disclosure, the accommodating shell includes a mounting base and a first connecting wall; the mounting base is barrel-shaped; a side wall and bottom wall of the mounting base form the accommodating slot; the side wall of the mounting base away from an edge of the bottom wall of the mounting base forms a third opening communicated to the accommodating slot; the first connecting wall extends outward along the side wall of the mounting base away from an edge of the bottom wall of the mounting base; the mounting base is placed in the inflation space; and the first connecting wall is connected to the position, close to the edge of the second opening, of the light-transmittance inner airbag.

As an improvement of the present disclosure, the position, close to the edge of the second opening, of the light-transmittance inner airbag protrudes outward to form a first connecting boss, and the first connecting wall is connected to the first connecting boss.

As an improvement of the present disclosure, a first limiting slot is provided on one side of the first connecting boss away from the inflation space, and the first connecting wall is inserted into the first limiting slot.

As an improvement of the present disclosure, an internal thread is formed on an upper side of the inner wall of the accommodating slot; an inner surface of the cover body extends downward to form an insertion block; and external thread is formed on an outer surface of the insertion block; and the external thread is in threaded connection to the internal thread.

As an improvement of the present disclosure, the insertion block is provided with a mounting slot; and when the cover body covers the accommodating slot, the light-emitting assembly is at least partially inserted into the mounting slot.

As an improvement of the present disclosure, the cover body is provided with a twisting groove on one side away from the inflation space, and the twisting groove is configured to allow insertion and use of an object to be twisted.

As an improvement of the present disclosure, the accommodating shell is at least partially transparent to allow light generated by the light-emitting assembly to pass through the accommodating shell and enter the inflation space.

As an improvement of the present disclosure, the light-emitting assembly includes a lamp panel, a battery, and a connecting frame; the connecting frame is connected to an upper surface of the lamp panel; and the battery is arranged between the connecting frame and the lamp panel.

As an improvement of the present disclosure, the lamp panel is provided with a light bead on one side away from the battery, and the light bead is oriented towards the inflation space.

As an improvement of the present disclosure, the light-emitting assembly further includes a sleeve; and the sleeve sleeves the connecting frame and abuts against an edge of an upper surface of the lamp panel.

As an improvement of the present disclosure, a handle is arranged at an upper part of the connecting frame; and the handle is configured to allow a user to grab.

As an improvement of the present disclosure, the connecting frame is made of a conductive material; an electrical connection block is arranged in a protruding manner on one side of the connecting frame facing the battery; a lower part of the connecting frame is electrically connected to the lamp panel; and the electrical connection block is electrically connected to one electrical contact of the battery.

As an improvement of the present disclosure, the lamp panel is further provided with a vibration switch; and the vibration switch is electrically connected to the lamp panel and controls the light bead to be turned on or turned off.

As an improvement of the present disclosure, the luminous ball further includes an inflation valve assembly; the light-transmittance inner airbag is provided with a fourth opening; the light-transmittance outer surface layer is provided with a fifth opening; the fifth opening corresponds to the fourth opening; and the inflation valve assembly is connected to a position, close to an edge of the fourth opening, of the light-transmittance inner airbag and a position, close to an edge of the fifth opening, of the light-transmittance outer surface layer.

As an improvement of the present disclosure, the inflation valve assembly includes a valve rod and a rubber plug; the rubber plug is provided with a connecting slot; the valve rod is inserted into the connecting slot; the valve rod is connected to a position, close to the edge of the fourth opening, of the light-transmittance inner airbag; and the rubber plug is connected to a position, close to the edge of the fifth opening, of the light-transmittance outer surface layer.

As an improvement of the present disclosure, an outer surface of the valve rod extends outward to form a second connecting wall; the position, close to the edge of the fourth opening, of the light-transmittance inner airbag protrudes outward to form a second connecting boss; and the second connecting wall is connected to the second connecting boss.

As an improvement of the present disclosure, a second limiting slot is provided on one side of the second connecting boss away from the inflation space, and the second connecting wall is inserted into the second limiting slot.

As an improvement of the present disclosure, the light-transmittance inner airbag is formed by connecting a plurality of sheets in sequence.

The present disclosure has the beneficial effects: By the arrangement of the above structure, during use, the light-emitting assembly is placed in the accommodating slot, and the cover body covers the accommodating slot. The cover body can effectively limit the light-emitting assembly, prevent the light-emitting assembly from shaking, and ensure the structural stability. A side wall of at least a portion of the accommodating slot is transparent. Light generated by the light-emitting assembly passes through the side walls of the accommodating slot and enters the light-transmittance inner airbag, and illuminates the light-transmittance inner airbag and the light-transmittance outer surface layer, making the product emit soft light. A user can easily observe the ball in a low light condition such as at night, which not only makes the product more beautiful, but also facilitates the user to observe and use the product. Preferably, the light-transmittance inner airbag is made of white transparent PVC and has a rough surface. The light generated by the light-emitting assembly illuminates the light-transmittance inner airbag, so that the light-transmittance inner airbag emits soft and uniform light. The soft light passes through a gap on the light-transmittance outer surface layer and illuminates the light-transmittance outer surface layer, making it convenient for the user to observe the product.

BRIEF DESCRIPTION OF DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE INVENTION

Figure 1:
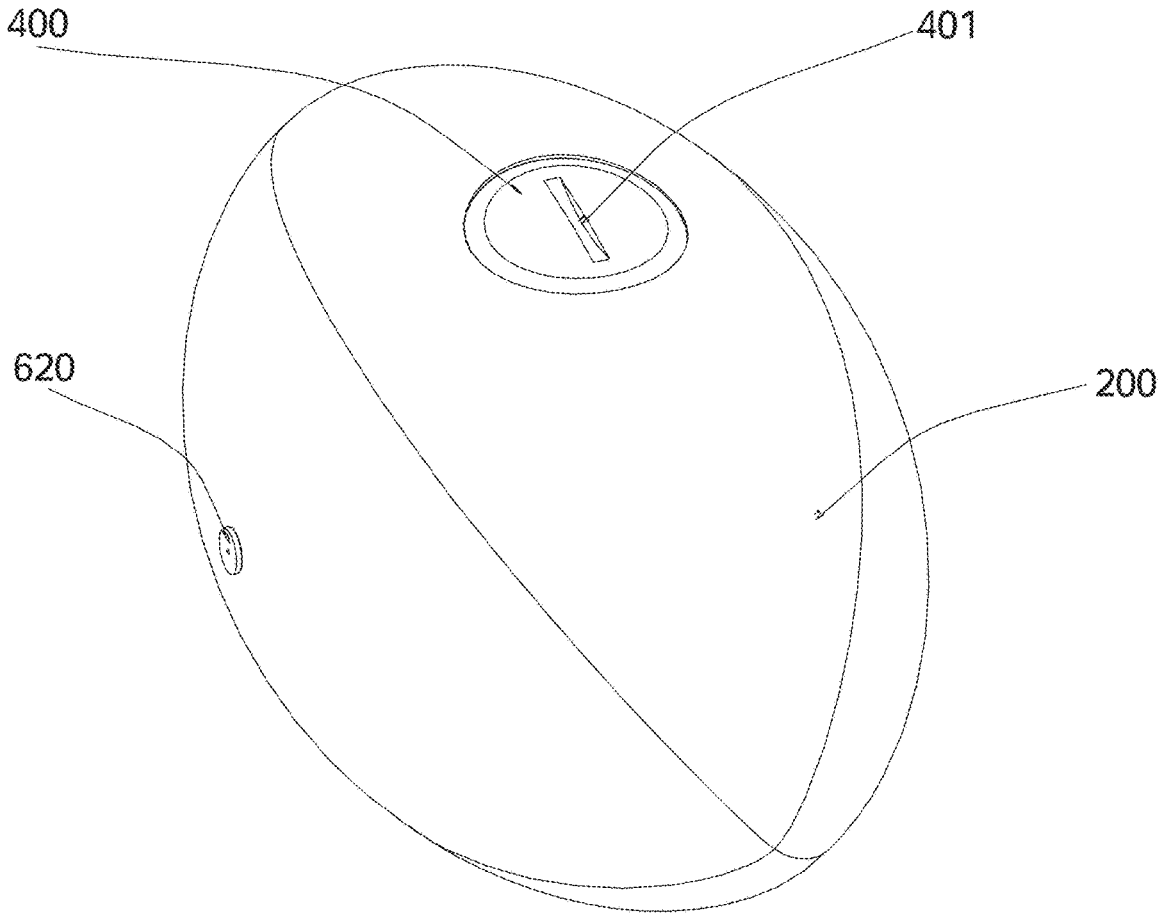
FIG. 1 is a schematic diagram of an entire structure according to a first embodiment of the present disclosure.

To make the aforementioned objectives, features, and advantages of the present disclosure more comprehensible, specific implementations of the present disclosure are described in detail below in conjunction with the accompanying drawings. In the following description, numerous specific details are set forth to provide a thorough understanding of the present disclosure. The present disclosure may, however, be embodied in many forms different from that described here. A person skilled in the art can make similar improvements without departing from the connotation of the present disclosure. Therefore, the present disclosure is not limited by the specific embodiments disclosed below.

In the description of the present disclosure, It is to be understood that, The terms “center”, “longitudinal”, “transverse”, “upper”, “lower”, “front”, “rear”, “left”, “right”, “vertical”, “horizontal”, “top”, “bottom”, “inner”, “outer”, “clockwise”, “counterclockwise”, and the like indicate azimuth or positional relationships based on the azimuth or positional relationships shown in the drawings, For purposes of convenience only of describing the present disclosure and simplifying the description, Rather than indicating or implying that the indicated device or element must have a particular orientation, be constructed and operated in a particular orientation, therefore, not to be construed as limiting the present disclosure.

In addition, the terms "first" and "second" are used for descriptive purposes only, while not to be construed as indicating or implying relative importance or implicitly specifying the number of technical features indicated thereby, features defining "first," "second," and "second" may explicitly or implicitly include one or more of the described features. In the description of the present disclosure, "multiple" means two or more unless explicitly specified otherwise.

In the description of the present disclosure, it is to be noted that unless otherwise expressly specified and defined, the terms "mounted", "connected", and "connected" are to be construed broadly, for example, as either a fixed connection, or a detachable connection, or an integral connection, either a mechanical connection, or an electrical connection. The specific meaning of the above term in the present disclosure will be understood by those of ordinary skill in the art depending on the particular circumstances, either directly or indirectly via an intermediate medium, communication between the two elements, or interaction between the two elements. The specific meanings of these terms in the present disclosure will be understood by those of ordinary skill in the art as the case may be.

In the present disclosure, unless specific regulation and limitation otherwise, the first feature "onto" or "under" the second feature may include the direct contact of the first feature and the second feature, or may include the contact of the first feature and the second feature through other features between them instead of direct contact. Moreover, the first feature "onto", "above" and "on" the second feature includes that the first feature is right above and obliquely above the second feature, or merely indicates that the horizontal height of the first feature is higher than the second feature. The first feature "under", "below" and "down" the second feature includes that the first feature is right above and obliquely above the second feature, or merely indicates that the horizontal height of the first feature is less than the second feature.

It should be noted that when an element is referred to as being "fixed to" another element, the element can be directly on another component or there can be a centered element. When an element is considered to be "connected" to another element, the element can be directly connected to another element or there may be a centered element. The terms "vertical", "horizontal", "up", "down", "left", "right", and similar expressions used herein are for illustrative purposes only and do not necessarily represent the only implementation.

Figure 2:
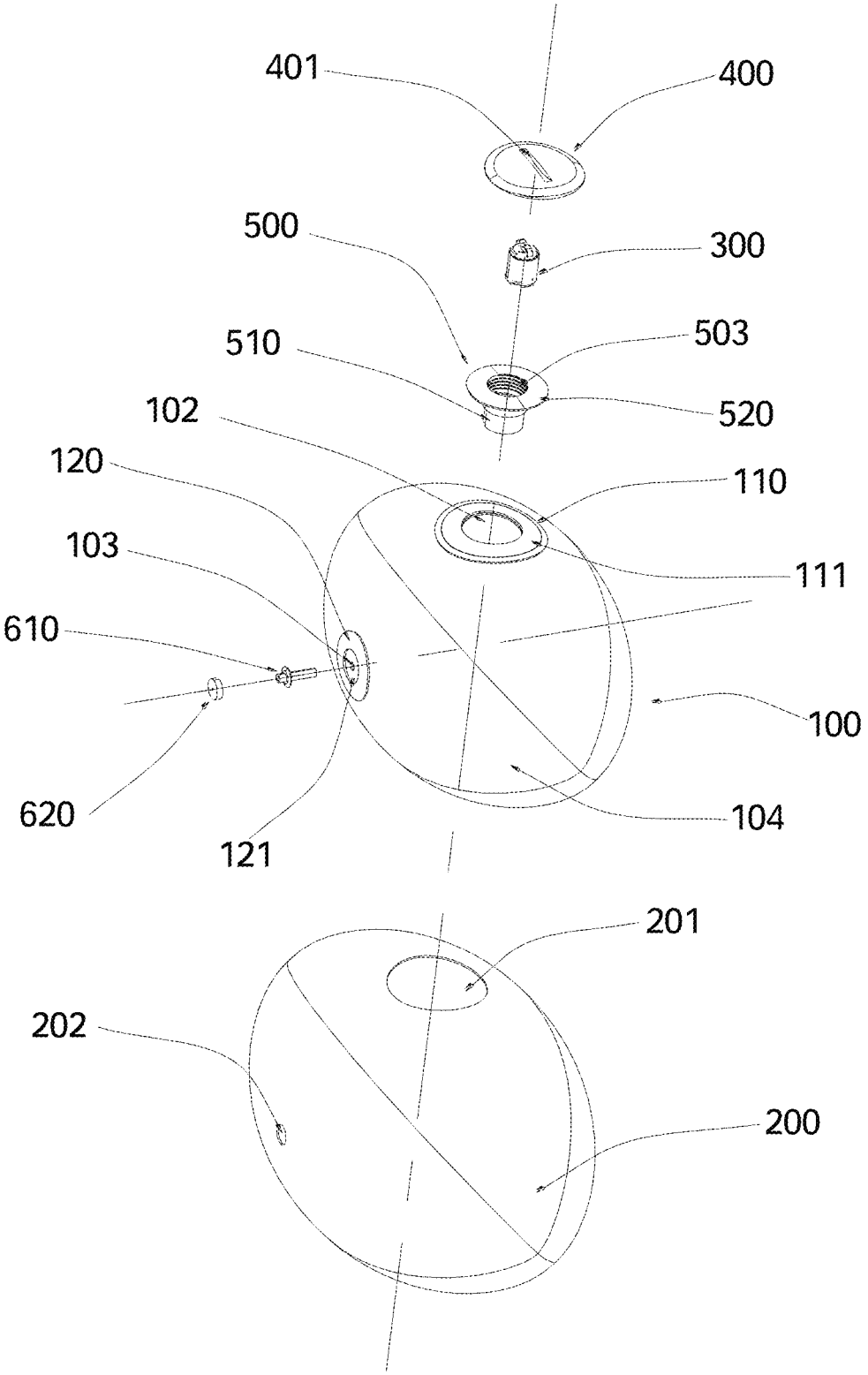
FIG. 2 is a schematic diagram of an exploded structure in an angle according to a first embodiment of the present disclosure.
Figure 3:
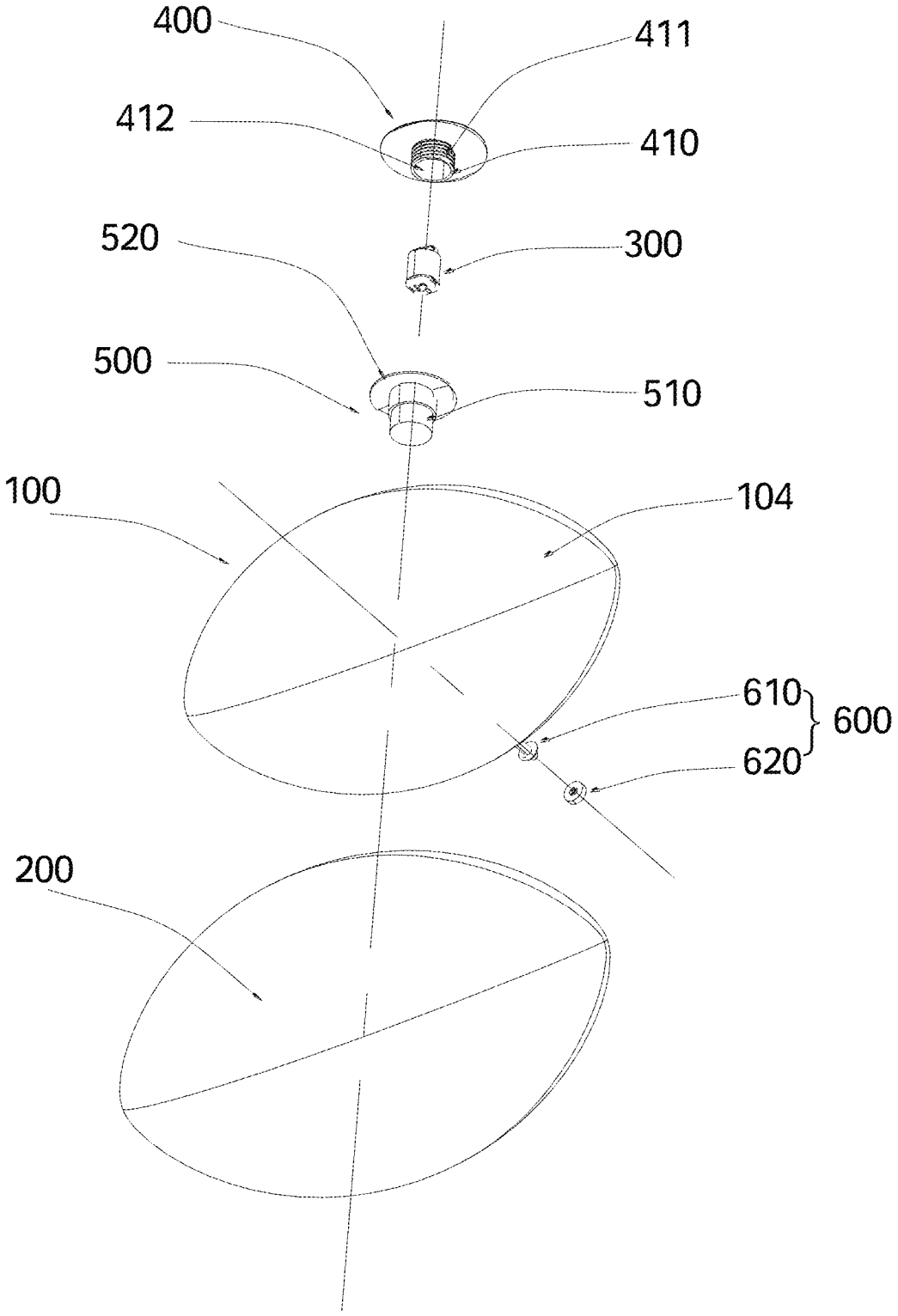
FIG. 3 is a schematic diagram of an exploded structure in another angle according to a first embodiment of the present disclosure.
Figure 4:
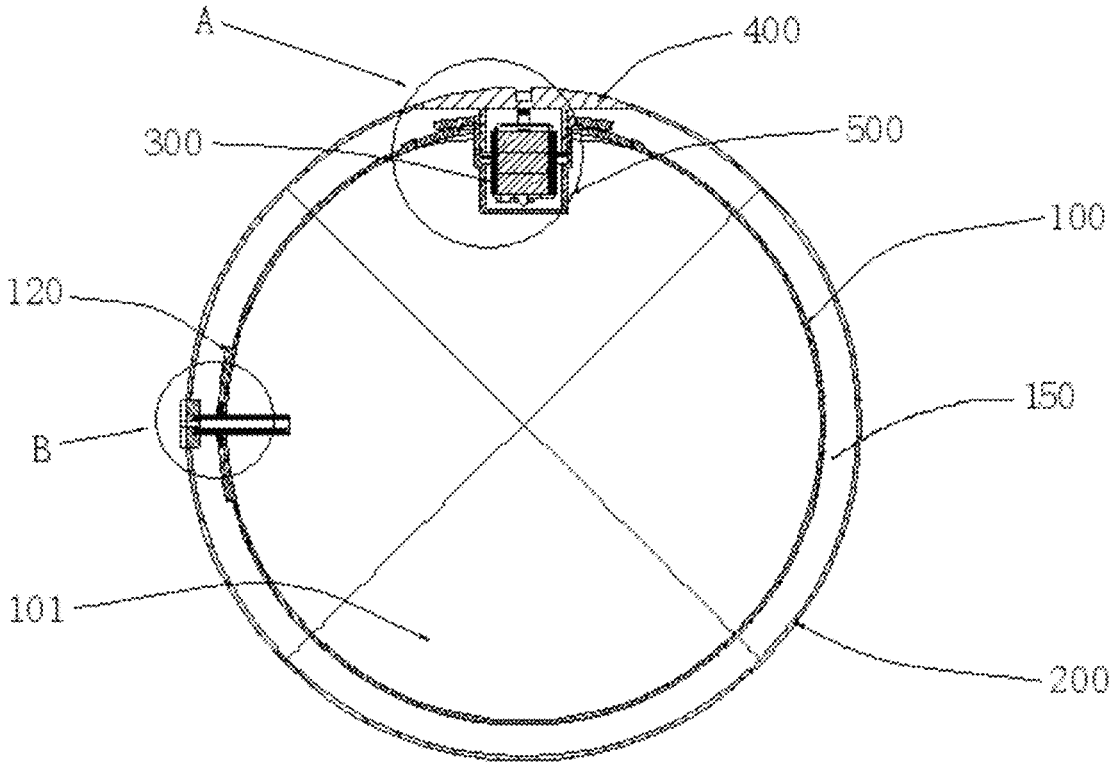
FIG. 4 is a schematic diagram of a cross-sectional structure according to a first embodiment of the present disclosure.
Figure 5:
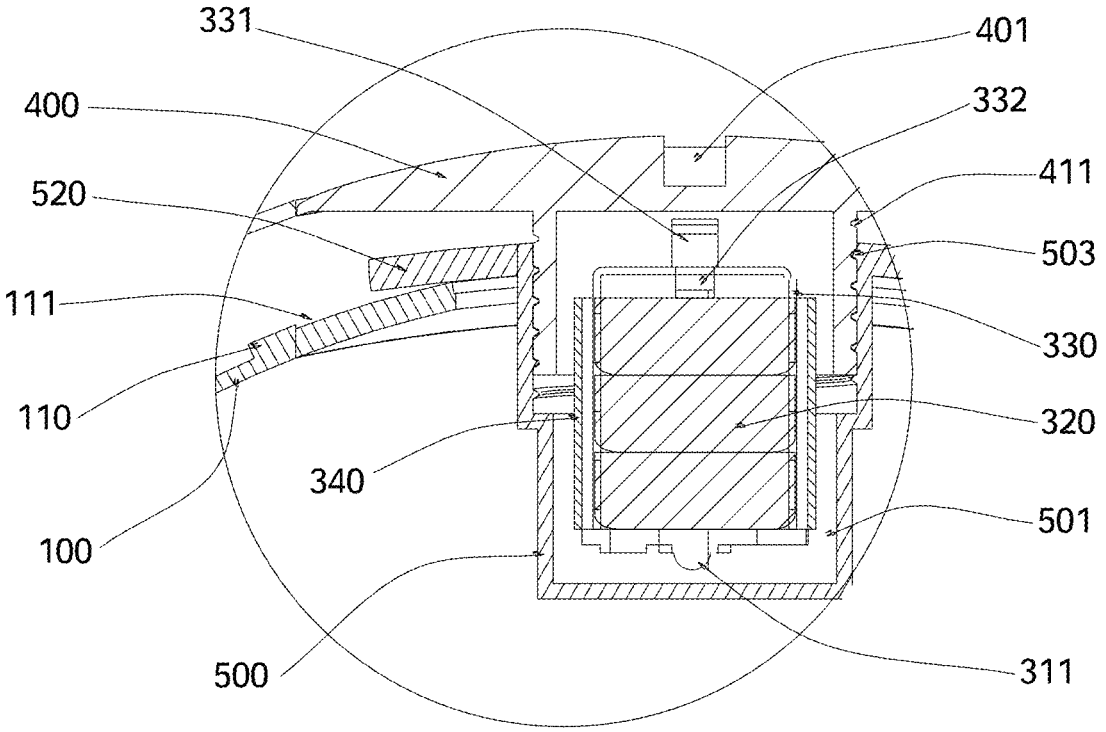
FIG. 5 is an enlarged view of circle A in FIG. 4.
Figure 6:
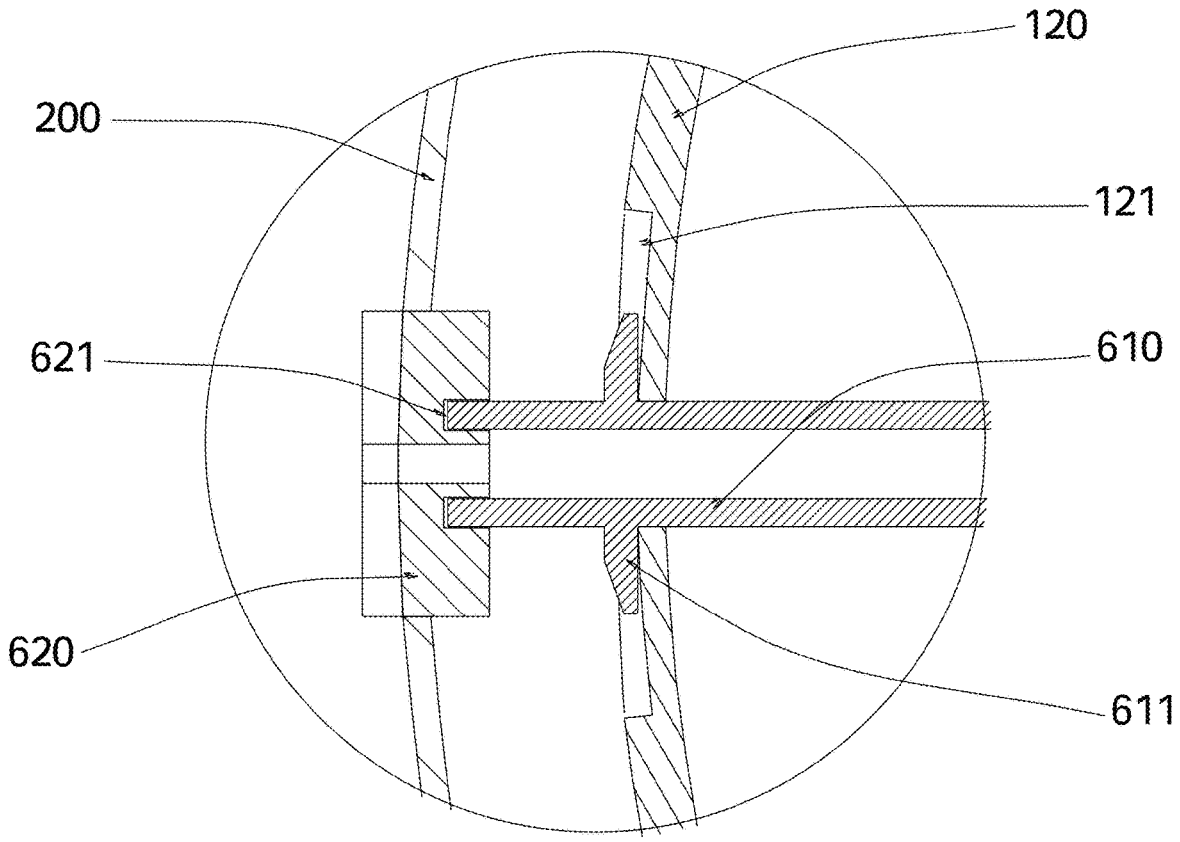
FIG. 6 is an enlarged view of circle B in FIG. 4.
Figure 7:
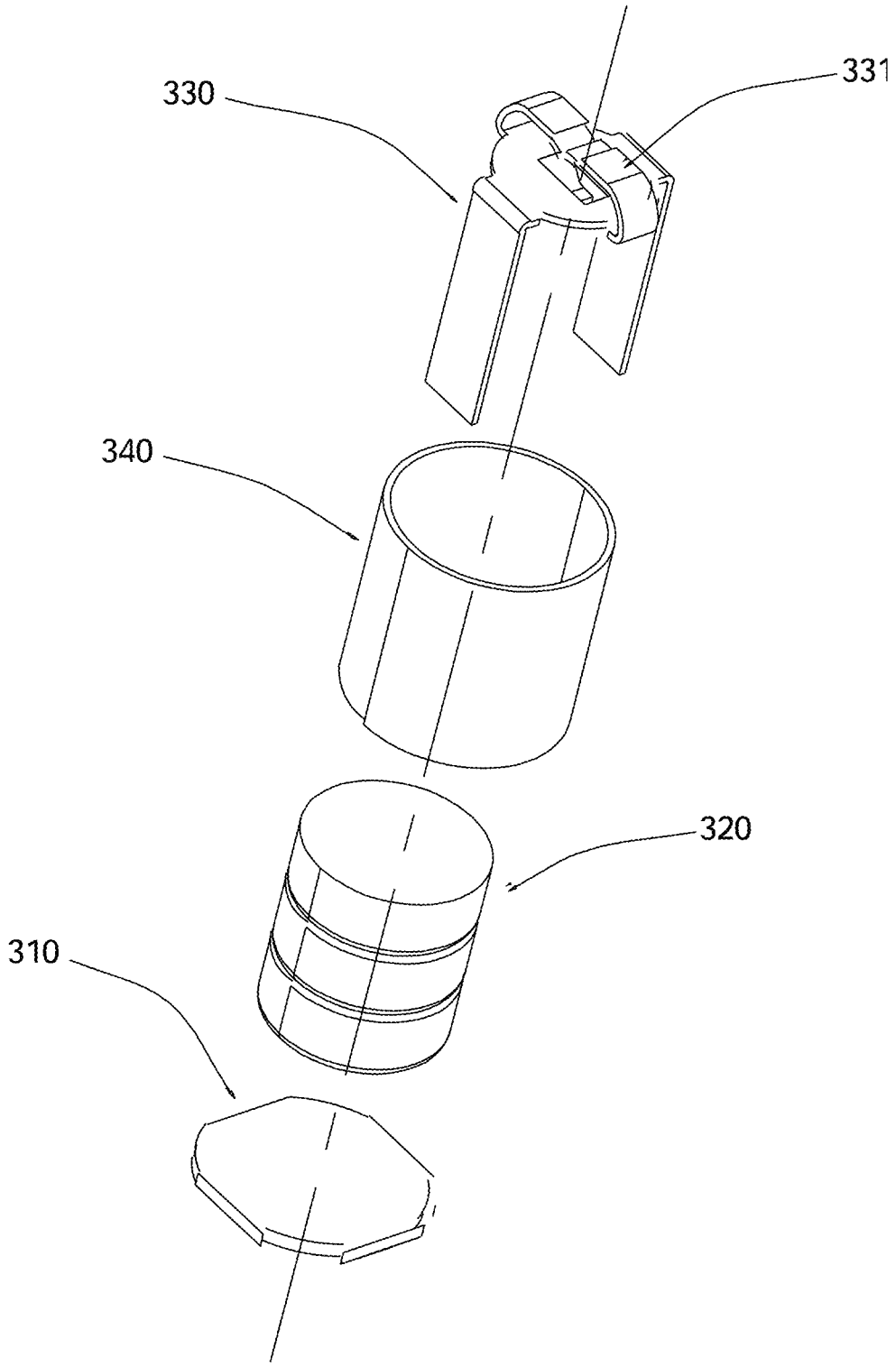
FIG. 7 is a schematic diagram of an exploded structure of a light-emitting assembly according to the present disclosure in one angle.
Figure 8:
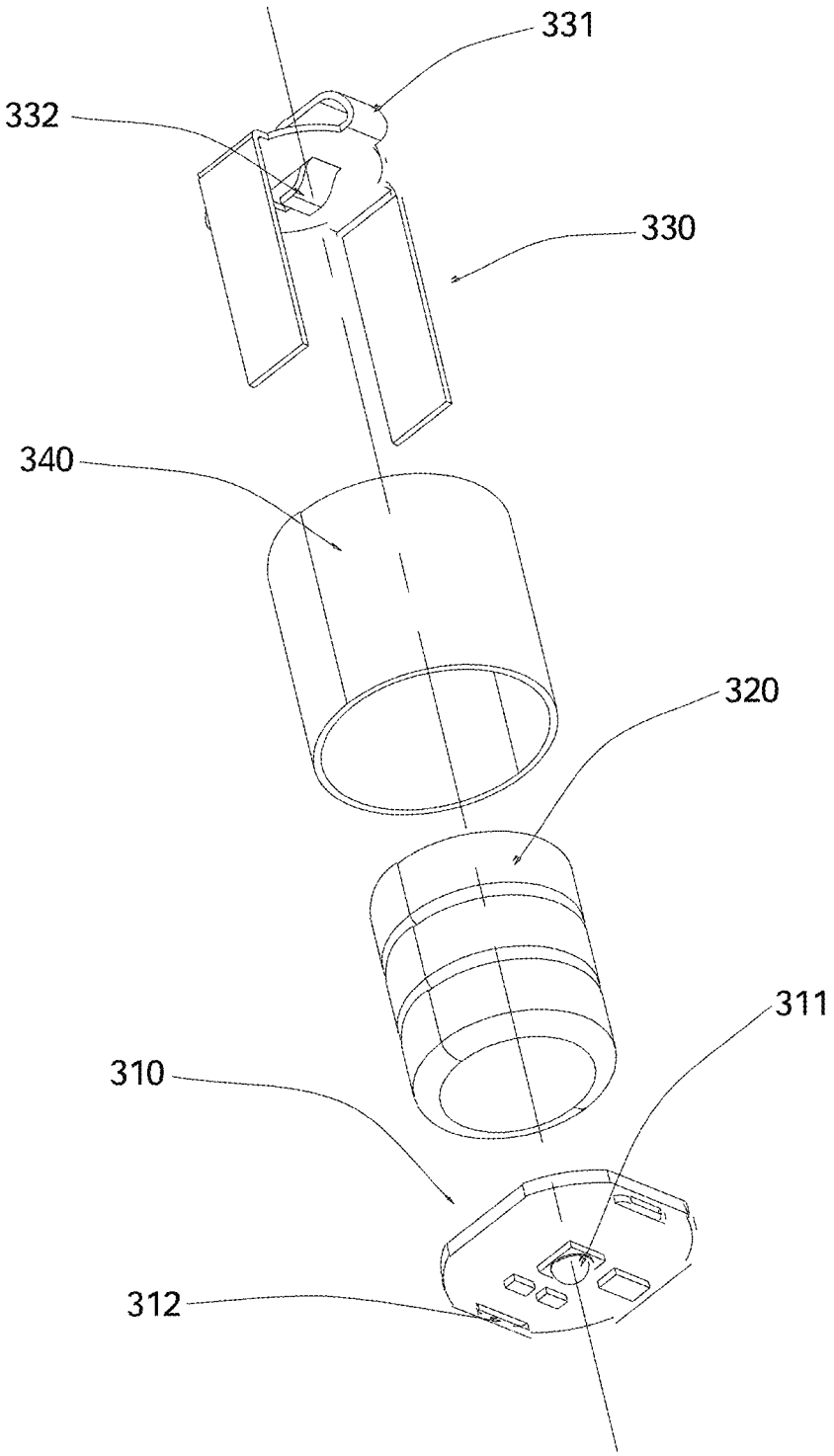
FIG. 8 is a structural exploded diagram of a light-emitting assembly according to the present disclosure in another angle.
Figure 9:
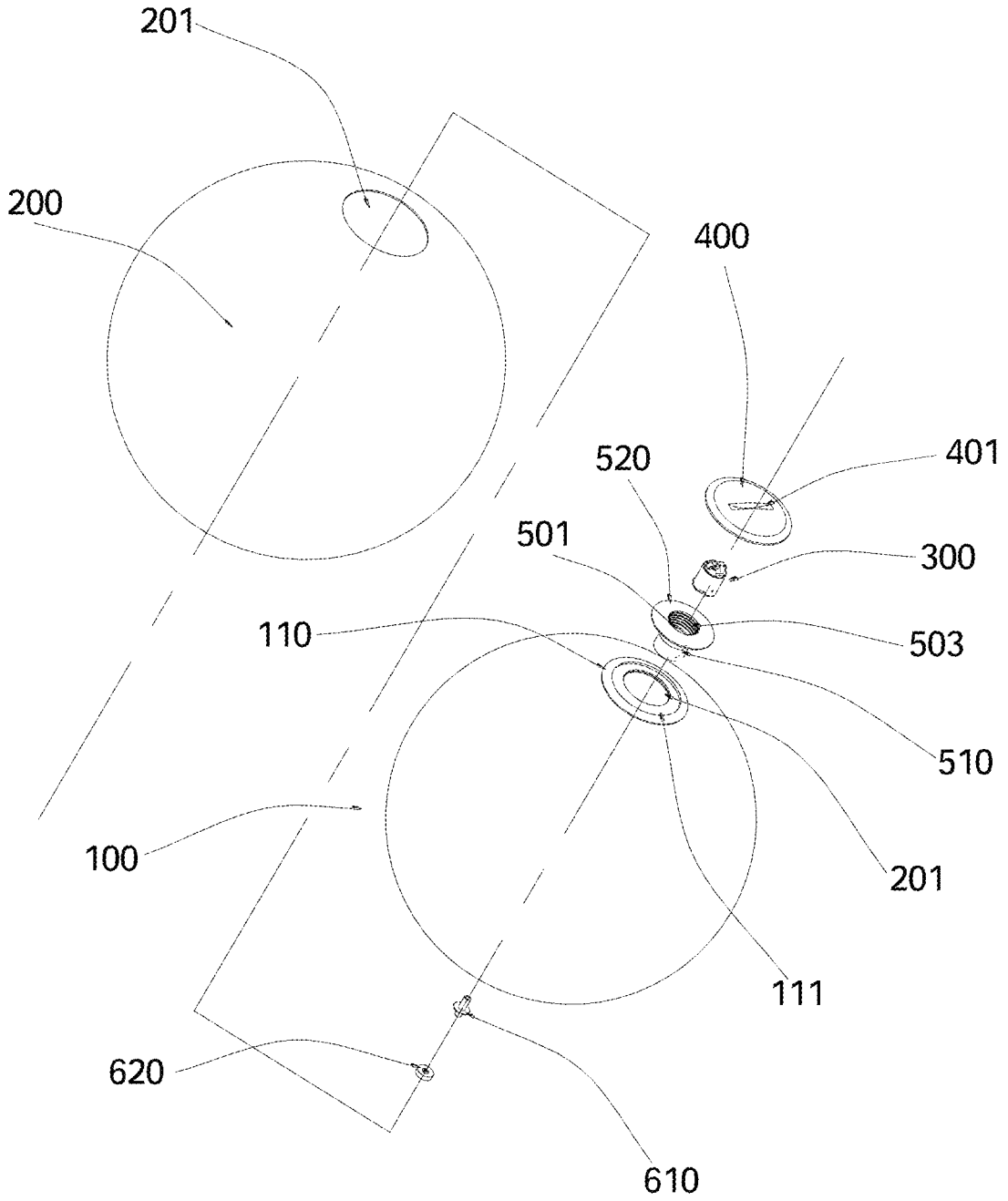
FIG. 9 is a schematic diagram of an exploded structure according to a second embodiment of the present disclosure in one angle.
Figure 10:
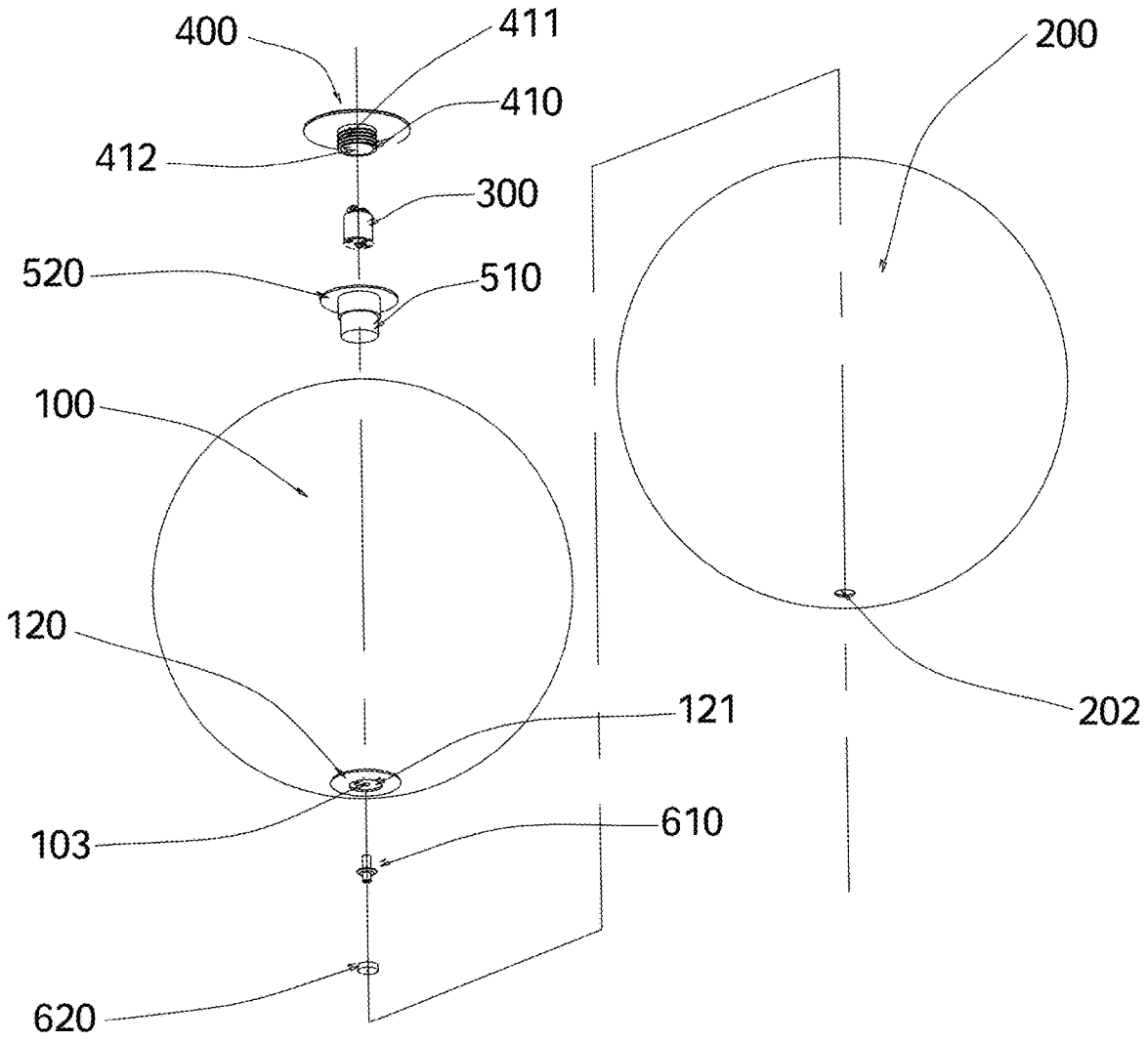
FIG. 10 is a schematic diagram of an exploded structure in an angle according to a second embodiment of the present disclosure.

Referring to FIG. 1 to FIG. 10, a luminous ball includes:

a light-transmittance inner airbag 100, wherein the light-transmittance inner airbag 100 defines an inflation space 101 and a second opening 102 communicated to the inflation space 101, and the light-transmittance inner airbag 100 is made of polyvinyl chloride (PVC) or rubber;

an accommodating shell 500, wherein an accommodating slot 501 is provided in the accommodating shell 500; the accommodating shell 500 is connected to a position, close to an edge of the second opening 102, of the light-transmittance inner airbag 100; the accommodating shell 500 is at least partially placed into the inflation space 101;

a light-transmittance outer surface layer 200, wherein the light-transmittance outer surface layer 200 is wrapped around an outer surface of the light-transmittance inner airbag 100, and an annular space 150 is maintained between the light-transmittance outer surface layer 200 and the light-transmittance inner airbag 100; the light-transmittance outer surface layer 200 is provided with a first opening 201; the first opening 201 corresponds to the second opening 102; and the light-transmittance outer surface layer 200 is made of PVC or fabric;

a light-emitting assembly 300, wherein the light-emitting assembly 300 is detachably inserted into the accommodating slot 501; and a cover body 400, wherein the cover body 400 is in detachable threaded connection to an inner wall of the accommodating slot 501 and covers the accommodating slot 501 to limit the light-emitting assembly 300 in the accommodating slot 501.

By the arrangement of the above structure, during use, the light-emitting assembly 300 is placed in the accommodating slot 501, and the cover body 400 covers the accommodating slot 501. The cover body 400 can effectively limit the light-emitting assembly 300, prevent the light-emitting assembly 300 from shaking, and ensure the structural stability. A side wall of at least a portion of the accommodating slot 501 is transparent. Light generated by the light-emitting assembly 300 passes through the side walls of the accommodating slot 501 and enters the light-transmittance inner airbag 100, and illuminates the light-transmittance inner airbag 100 and the light-transmittance outer surface layer 200, making the product emit soft light. A user can easily observe the ball in a low light condition such as at night, which not only makes the product more beautiful, but also facilitates the user to observe and use the product. Preferably, the light-transmittance inner airbag 100 is made of white transparent PVC and has a rough surface. The light generated by the light-emitting assembly 300 illuminates the light-transmittance inner airbag 100, so that the light-transmittance inner airbag 100 emits soft and uniform light. The soft light passes through a gap on the light-transmittance outer surface layer 200 and illuminates the light-transmittance outer surface layer 200, making it convenient for the user to observe the product. During use, an edge of the accommodating shell 500 is to the light-transmittance inner airbag 100 at the edge of the second opening 102 to achieve sealed connection between the accommodating shell 500 and the light-transmittance inner airbag 100. The accommodating slot 501 is arranged in the accommodating shell 500 to reduce the production difficulty, improve the production efficiency of the product, and increase the yield of the product under the condition of ensuring the airtightness of the product. Moreover, the cover body 400 is in threaded connection to the inner wall of the accommodating slot 501, which can make it convenient for a user to disassemble and assemble the cover body 400, thereby replacing the battery for the light-emitting assembly 300 or replacing the light-emitting assembly 300 and prolonging the battery life and service life of the product. Moreover, the threaded connection can enhance the sealing performance between the cover body 400 and the accommodating slot 501, prevent water from entering the light-emitting assembly, and ensuring the stability of the product. Furthermore, since the light-transmittance outer surface layer 200 is made of the PVC or fabric, the light-transmittance outer surface layer 200 is softer and has a better hand feel, and the user feels more comfortable when holding the product. Meanwhile, antiskid lines are provided on an outer surface of the light-transmittance outer surface layer 200 made of the PVC or fabric, so that the surface friction coefficient is large, which can effectively achieve skid resistance, and the user holds the product more stably. The friction coefficient can be further increased by adding antiskid silica gel patterns, to enhance the antiskid effect. Furthermore, due to good light transmittance, light generated by the light-emitting assembly 300 passes through the light-transmittance outer surface layer 200 more easily, so that the product has higher brightness, which facilitates the user to observe the product under a low light condition.

In this embodiment, the accommodating shell 500 includes a mounting base 510 and a first connecting wall 520; the mounting base 510 is barrel-shaped; a side wall and bottom wall of the mounting base 510 form the accommodating slot 501; the side wall of the mounting base 510 away from an edge of the bottom wall of the mounting base 510 forms a third opening communicated to the accommodating slot 501; the first connecting wall 520 extends outward along the side wall of the mounting base 510 away from an edge of the bottom wall of the mounting base 510; the mounting base 510 is placed in the inflation space 101; and the first connecting wall 520 is connected to the position, close to the edge of the second opening 102, of the light-transmittance inner airbag 100. By the arrangement of the above structure, the side wall and bottom wall of the barrel-shaped mounting base 510 form the accommodating slot 501, and the light-emitting assembly 300 is inserted into the accommodating slot 501 along the third opening, which not only facilitates the mounting of the light-emitting assembly 300, but also stably stores the light-emitting assembly 300, so that the structure of the product is stable. Moreover, the first connecting wall 520 is connected to the edge of the second opening 102, and the mounting base 510 is inserted into the inflation space 101. The product is convenient to assembly, and a surface of the product can be kept flat, so that the product is more beautiful and is more convenient to use.

In this embodiment, the position, close to the edge of the second opening 102, of the light-transmittance inner airbag 100 protrudes outward to form a first connecting boss 110, and the first connecting wall 520 is connected to the first connecting boss 110. By the arrangement of the above structure, the first connecting boss 110 is arranged at the edge of the second opening 102, which can effectively increase the thickness of this place, enhance the strength of the edge of the second opening 102, prevent the light-transmittance inner airbag 100 from being torn at the edge of the second opening 102, and effectively prolong the service life of the product. Meanwhile, this can further facilitate the mounting of the accommodating shell 500. When the first connecting wall 520 is connected, the first connecting boss 110 does not easily deform, thereby improving the mounting efficiency.

In this embodiment, a first limiting slot 111 is provided on one side of the first connecting boss 110 away from the inflation space 101, and the first connecting wall 520 is inserted into the first limiting slot 111. By the arrangement of the above structure, the first limiting slot 111 can effectively limit the first connecting wall 520. To assemble the product, the first connecting wall 520 can be accurately connected to the first limiting slot 111 on the first connecting boss 110, thereby improving the assembling efficiency of the product and ensuring the yield of the product. Preferably, glue is usually used to connect the first connecting wall 520 to the first connecting boss 110. The first limiting slot 111 can effectively accommodate the glue and the first connecting wall 520, so that the connection between the first connecting wall 520 and the first connecting boss 110 is more stable and firmer.

In this embodiment, an internal thread 503 is formed on an upper side of the inner wall of the accommodating slot 501; an inner surface of the cover body 400 extends downward to form an insertion block 410; and external thread 411 is formed on an outer surface of the insertion block 410; and the external thread 411 is in threaded connection to the internal thread 503. By the arrangement of the above structure, during use, the cover body 400 is twisted clockwise to achieve the threaded connection of the external thread 411 to the internal thread 503, which can achieve stable connection between the cover body 400 and the accommodating slot 501, thereby fixing the light-emitting assembly 300 and improving the stability of the product. The product is convenient to use. To repair or replace the light-emitting assembly 300, the cover body 400 is twisted anticlockwise to be removed, making it easy for a user to take out the light-emitting assembly 300. The product is convenient to use.

In this embodiment, the insertion block 410 is provided with a mounting slot 412; and when the cover body 400 covers the accommodating slot 501, the light-emitting assembly 300 is at least partially inserted into the mounting slot 412. By the arrangement of the above structure, during use, the cover body 400 covers the accommodating slot 501. At this time, an upper part of the light-emitting assembly 300 is inserted into the mounting slot 412, and a lower part of the light-emitting assembly 300 is inserted into the accommodating slot 501, which can further limit the light-emitting assembly 300, prevent the light-emitting assembly 300 from shaking, ensure that light generated by the light-emitting assembly 300 is projected into the inflation space 101, prevent damage caused by collision during shaking of the light-emitting assembly 300, and prolong the service life of the product.

In this embodiment, the cover body 400 is provided with a twisting groove 401 on one side away from the inflation space 101, and the twisting groove 401 is configured to allow insertion and use of an object to be twisted. By the arrangement of the above structure, during use, a nail, a coin, or a screwdriver is inserted into the twisting groove 401, so that the cover body 400 can be easily and effortlessly twisted, thereby facilitating operations of a user and enhancing the user experience.

In this embodiment, the accommodating shell 500 is at least partially transparent to allow light generated by the light-emitting assembly 300 to pass through the accommodating shell 500 and enter the inflation space 101. By the arrangement of the above structure, during use, light generated by the light-emitting assembly 300 passes through the transparent portion of the accommodating shell 500 and enters the inflation space 101, which effectively illuminates the entire light-transmittance inner airbag 100 and the light-transmittance outer surface layer 200, so that the product emits soft light. A user can easily observe the ball in a low light condition such as at night, and the user experience of using the product at night is enhanced.

In this embodiment, the light-emitting assembly 300 includes a lamp panel 310, a battery 320, and a connecting frame 330; the connecting frame 330 is connected to an upper surface of the lamp panel 310; and the battery 320 is arranged between the connecting frame 330 and the lamp panel 310. By the arrangement of the above structure, the connecting frame 330 is connected to the lamp panel 310, which not only achieves electrical connection between them, but also defining a mounting space. The battery 320 is placed in the mounting space, and two contacts of the battery 320 are respectively in contact with an electrical contact on the connecting frame 330 and an electrical contact on the lamp panel 310, so that the battery 320 can effectively supply power to the lamp panel 310. The connecting frame 330 and the lamp panel 310 can effectively limit the battery 320, making the structure of the product more stable.

In this embodiment, the lamp panel 310 is provided with a light bead 311 on one side away from the battery 320, and the light bead 311 is oriented towards the inflation space 101. By the arrangement of the above structure, the light bead 311 is oriented towards the inflation space 101, and light emitted by the light bead 311 directly irradiates the inner wall of the light-transmittance inner airbag 100 to light up the light-transmittance inner airbag 100 and the light-transmittance outer surface layer 200, making it easier for a user to observe the product at night and to use the product more conveniently.

In this embodiment, the light-emitting assembly 300 further includes a sleeve 340; and the sleeve 340 sleeves the connecting frame 330 and abuts against an edge of an upper surface of the lamp panel 310. By the arrangement of the above structure, during use, the battery 320 is placed between the connecting frame 330 and the lamp panel 310, and the sleeve 340 sleeves the connecting frame 330. The sleeve 340 can effectively limit the battery 320, prevent the battery 320 from shifting, and improve the stability of the product.

In this embodiment, a handle 331 is arranged at an upper part of the connecting frame 330; and the handle 331 is configured to allow a user to grab. By the arrangement of the above structure, to take out the light-emitting assembly 300, a user can grasp the handle 331, making it convenient for the user to take out the light-emitting assembly 300 and mount or remove the light-emitting assembly 300. The user operation is simple and convenient.

In this embodiment, the connecting frame 330 is made of a conductive material; an electrical connection block 332 is arranged in a protruding manner on one side of the connecting frame 330 facing the battery 320; a lower part of the connecting frame 330 is electrically connected to the lamp panel 310; and the electrical connection block 332 is electrically connected to one electrical contact of the battery 320. By the arrangement of the above structure, the connecting frame 330 is made of the conductive material. During use, the electrical connection block 332 is connected to one of a positive electrode and a negative electrode of the battery 320, and the lamp panel 310 is connected to the other one of the positive electrode and the negative electrode of the battery 320. The connecting frame 330 is electrically connected to the lamp panel 310 to achieve conduction of a circuit, so that the battery 320 can effectively supply power to the lamp panel 310. Preferably, an insulation sheet can be inserted between the electrical connection block 332 and the battery 320 to disconnect the circuit and save power. In addition, a surface of the electrical connection block 332 has a smooth curved surface on at least one side, making it convenient for a user to insert or remove the insulation sheet.

In this embodiment, the lamp panel 310 is further provided with a vibration switch 312; and the vibration switch 312 is electrically connected to the lamp panel 310 and controls the light bead 311 to be turned on or turned off. By the arrangement of the above structure, the vibration switch 312 can be used to detect whether the product is in use. When in use, the vibration switch 312 detects vibration and outputs a vibration signal. The lamp panel 310 receives the vibration signal and controls the light bead 311 to be turned on. When not in use, the product remains stationary and the vibration switch 312 cannot detect any vibration. The lamp panel 310 controls the light bead 311 to be turned off, which can achieve lighting in the use state and save power in the non-use state.

In this embodiment, the luminous ball further includes an inflation valve assembly 600; the light-transmittance inner airbag 100 is provided with a fourth opening 103; the light-transmittance outer surface layer 200 is provided with a fifth opening 202; the fifth opening 202 corresponds to the fourth opening 103; and the inflation valve assembly 600 is connected to a position, close to an edge of the fourth opening 103, of the light-transmittance inner airbag 100 and a position, close to an edge of the fifth opening 202, of the light-transmittance outer surface layer 200. By the arrangement of the above structure, to assemble the product, the inflation valve assembly 600 is inserted along the fifth opening 202 and the fourth opening 103, and the inflation valve assembly 600 is connected to the edge of the fifth opening 202 and the edge of the fourth opening 103 to achieve sealed connection of the product. Meanwhile, it also allows a user to inflate the inflation space 101 through the inflation valve assembly 600, so that the product is more convenient to use.

In this embodiment, the inflation valve assembly 600 includes a valve rod 610 and a rubber plug 620; the rubber plug 620 is provided with a connecting slot 621; the valve rod 610 is inserted into the connecting slot 621; the valve rod 610 is connected to a position, close to the edge of the fourth opening 103, of the light-transmittance inner airbag 100; and the rubber plug 620 is connected to a position, close to the edge of the fifth opening 202, of the light-transmittance outer surface layer 200. By the arrangement of the above structure, the valve rod 610 is inserted into the connecting slot 621, which can effectively achieve sealed connection between the valve rod 610 and the rubber plug 620. The valve rod 610 is connected to the edge of the fourth opening 103, and the rubber plug 620 is connected to the edge of the fifth opening 202, which can effectively improve the connection strength and make the structure of the product more stable.

In this embodiment, an outer surface of the valve rod 610 extends outward to form a second connecting wall 611; the position, close to the edge of the fourth opening 103, of the light-transmittance inner airbag 100 protrudes outward to form a second connecting boss 120; and the second connecting wall 611 is connected to the second connecting boss 120. By the arrangement of the above structure, during use, the second connecting wall 611 is connected to the second connecting boss 120, making it convenient for a user to mount the valve rod 610. Meanwhile, the protruding second connecting boss 120 is arranged at the position, close to the edge of the fourth opening 103, of the light-transmittance inner airbag 100, which can increase the thickness of the product in this place, improve the strength, and prevent the light-transmittance inner airbag 100 from being torn along the fourth opening 103.

In this embodiment, a second limiting slot 121 is provided on one side of the second connecting boss 120 away from the inflation space 101, and the second connecting wall 611 is inserted into the second limiting slot 121. By the arrangement of the above structure, the second limiting slot 121 can effectively limit the second connecting wall 611. To assemble the product, the second connecting wall 611 can be accurately connected to the second limiting slot 121 on the second connecting boss 120, thereby improving the assembling efficiency of the product and ensuring the yield of the product. Preferably, glue is usually used to connect the second connecting wall 611 to the second connecting boss 120. The second limiting slot 121 can effectively accommodate the glue and the second connecting wall 611, so that the connection between the second connecting wall 611 and the second connecting boss 120 is more stable and firmer.

In this embodiment, the light-transmittance inner airbag 100 is formed by connecting a plurality of sheets 104 in sequence. By the arrangement of the above structure, the plurality of sheets 104 are connected to form the light-transmittance inner airbag 100, which can improve the production efficiency and yield of the product. Preferably, the plurality of sheets 104 are connected through high-frequency welding, making the connection closer. The product has good airtightness and is firmer.

In this embodiment, the light-transmittance inner airbag 100 is a rubber airbag. The rubber is placed in a mold to be spherical, and is made firmer and more durable through vulcanization treatment. The light-transmittance inner airbag is reinforced by winding yarn made of a nylon wire or a polyester mixture to maintain its shape stability, and a rubber layer is added to improve the stability and elasticity of the product.

In this embodiment, the light-transmittance outer surface layer 200 is made of polyester fabric or foamed PVC light-transmittance sheet. It is sewn to form the spherical or fusiform light-transmittance outer surface layer 200 and wrapped around the outer surface of the light-transmittance inner airbag 100.

The invention claimed is:

1. A luminous ball, comprising:

a light-transmittance inner airbag, wherein the light-transmittance inner airbag defines an inflation space and a second opening communicated to the inflation space, and the light-transmittance inner airbag is made of polyvinyl chloride (PVC) or rubber;

an accommodating shell, wherein an accommodating slot is provided in the accommodating shell; the accommodating shell is connected to a position, close to an edge of the second opening, of the light-transmittance inner airbag; the accommodating shell is at least partially placed into the inflation space;

a light-transmittance outer surface layer, wherein the light-transmittance outer surface layer is wrapped around an outer surface of the light-transmittance inner airbag, and an annular space is maintained between the light-transmittance outer surface layer and the light-transmittance inner airbag; the light-transmittance outer surface layer is provided with a first opening; the first opening corresponds to the second opening; and the light-transmittance outer surface layer is made of PVC or fabric;

a light-emitting assembly, wherein the light-emitting assembly is detachably inserted into the accommodating slot; and a cover body, wherein the cover body is positioned at the first opening and extends through the annular space to be in detachable threaded connection to an inner wall of the accommodating slot and covers the accommodating slot to limit the light-emitting assembly in the accommodating slot.

2. The luminous ball according to claim 1, wherein the accommodating shell comprises a mounting base and a first connecting wall; the mounting base is barrel-shaped; a side wall and bottom wall of the mounting base form the accommodating slot; the side wall of the mounting base away from an edge of the bottom wall of the mounting base forms a third opening communicated to the accommodating slot; the first connecting wall extends outward along the side wall of the mounting base away from an edge of the bottom wall of the mounting base; the mounting base is placed in the inflation space; and the first connecting wall is connected to the position, close to the edge of the second opening, of the light-transmittance inner airbag.

3. The luminous ball according to claim 2, wherein the position, close to the edge of the second opening, of the light-transmittance inner airbag protrudes outward to form a first connecting boss, and the first connecting wall is connected to the first connecting boss.

4. The luminous ball according to claim 3, wherein a first limiting slot is provided on one side of the first connecting boss away from the inflation space, and the first connecting wall is inserted into the first limiting slot.

5. The luminous ball according to claim 1, wherein an internal thread is formed on an upper side of the inner wall of the accommodating slot; an inner surface of the cover body extends downward to form an insertion block; and external thread is formed on an outer surface of the insertion block; and the external thread is in threaded connection to the internal thread.

6. The luminous ball according to claim 5, wherein the insertion block is provided with a mounting slot; and when the cover body covers the accommodating slot, the light-emitting assembly is at least partially inserted into the mounting slot.

7. The luminous ball according to claim 5, wherein the cover body is provided with a twisting groove on one side away from the inflation space, and the twisting groove is configured to allow insertion and use of an object to be twisted.

8. The luminous ball according to claim 1, wherein the accommodating shell is at least partially transparent to allow light generated by the light-emitting assembly to pass through the accommodating shell and enter the inflation space.

9. The luminous ball according to claim 1, wherein the light-emitting assembly comprises a lamp panel, a battery, and a connecting frame; the connecting frame is connected to an upper surface of the lamp panel; and the battery is arranged between the connecting frame and the lamp panel.

10. The luminous ball according to claim 9, wherein the lamp panel is provided with a light bead on one side away from the battery, and the light bead is oriented towards the inflation space.

11. The luminous ball according to claim 9, wherein the light-emitting assembly further comprises a sleeve; and the sleeve sleeves the connecting frame and abuts against an edge of an upper surface of the lamp panel.

12. The luminous ball according to claim 9, wherein a handle is arranged at an upper part of the connecting frame; and the handle is configured to allow a user to grab.

13. The luminous ball according to claim 9, wherein the connecting frame is made of a conductive material; an electrical connection block is arranged in a protruding manner on one side of the connecting frame facing the battery; a lower part of the connecting frame is electrically connected to the lamp panel; and the electrical connection block is electrically connected to one electrical contact of the battery.

14. The luminous ball according to claim 10, wherein the lamp panel is further provided with a vibration switch; and the vibration switch is electrically connected to the lamp panel and controls the light bead to be turned on or turned off.

15. The luminous ball according to claim 1, wherein the luminous ball further comprises an inflation valve assembly;

the light-transmittance inner airbag is provided with a fourth opening; the light-transmittance outer surface layer is provided with a fifth opening; the fifth opening corresponds to the fourth opening; and the inflation valve assembly is located close to an edge of the fourth opening of the light-transmittance inner airbag and close to an edge of the fifth opening of the light-transmittance outer surface layer.

16. The luminous ball according to claim 15, wherein the inflation valve assembly comprises a valve rod and a rubber plug; the rubber plug is provided with a connecting slot; the valve rod is inserted into the connecting slot; the valve rod is positioned close to the edge of the fourth opening of the light-transmittance inner airbag; and the rubber plug is positioned close to the edge of the fifth opening of the light-transmittance outer surface layer.

17. The luminous ball according to claim 16, wherein an outer surface of the valve rod extends outward to form a second connecting wall; the light-transmittance inner airbag protrudes outward to form a second connecting boss close to the edge of the fourth opening; and the second connecting wall is connected to the second connecting boss.

18. The luminous ball according to claim 17, wherein a second limiting slot is provided on one side of the second connecting boss away from the inflation space, and the second connecting wall is inserted into the second limiting slot.

19. The luminous ball according to claim 1, wherein the light-transmittance inner airbag is formed by connecting a plurality of sheets in sequence.

20. A luminous ball, comprising:

a light-transmittance inner airbag, wherein the light-transmittance inner airbag defines an inflation space and a second opening communicated to the inflation space, the light-transmittance inner airbag is made of polyvinyl chloride (PVC) or rubber, and the light-transmittance inner airbag is formed by connecting a plurality of sheets in sequence;

an accommodating shell, wherein an accommodating slot is provided in the accommodating shell; the accommodating shell is connected to a position, close to an edge of the second opening, of the light-transmittance inner airbag; the accommodating shell is at least partially placed into the inflation space;

a light-transmittance outer surface layer, wherein the light-transmittance outer surface layer is wrapped around an outer surface of the light-transmittance inner airbag, and an annular space is maintained between the light-transmittance outer surface layer and the light-transmittance inner airbag; the light-transmittance outer surface layer is provided with a first opening; the first opening corresponds to the second opening; and the light-transmittance outer surface layer is made of PVC or fabric;

a light-emitting assembly, wherein the light-emitting assembly is detachably inserted into the accommodating slot;

an inflation valve assembly positioned at the light-transmittance outer surface layer, and extending through the annular space to extend into the light-transmittance inner airbag; and a cover body, wherein the cover body covers the first opening and extends through the annular space to be in detachable threaded connection to an inner wall of the accommodating slot to limit the light-emitting assembly in the accommodating slot.

* * * * *